United States Patent [19]

Matsuda

[11] Patent Number: 4,602,591

[45] Date of Patent: Jul. 29, 1986

[54] LINING APPARATUS FOR PIPES

[76] Inventor: Shinichi Matsuda, 32-14, Higiriyama, 1-chome, Konan-ku, Yokohama, Kanagawa 233, Japan

[21] Appl. No.: 730,483

[22] Filed: May 6, 1985

[30] Foreign Application Priority Data

May 25, 1984 [JP] Japan ..... 59-104500

[51] Int. Cl.[4] ..... B05B 13/06; B05C 5/00

[52] U.S. Cl. ..... 118/306; 118/317; 118/DIG. 10; 239/214; 239/432; 239/590.5

[58] Field of Search ..... 118/306, 317, DIG. 10; 239/214, 432, 590.5

[56] References Cited

U.S. PATENT DOCUMENTS

| | | | |
|---|---|---|---|
| 2,910,042 | 10/1959 | Gallmeyer et al. | 118/306 X |
| 3,135,629 | 6/1964 | McLean | 118/DIG. 10 X |
| 3,753,766 | 8/1973 | Brown et al. | 118/306 X |
| 4,370,062 | 1/1983 | Moody | 239/432 |
| 4,377,127 | 3/1983 | Tinchon | 118/306 |

*Primary Examiner*—Shrive P. Beck

*Attorney, Agent, or Firm*—Oblon, Fisher, Spivak, McClelland & Maier

[57] ABSTRACT

The present invention relates to a lining apparatus for a pipe having a plurality of constitutive elements which are connected to each other in a line and include as a whole at least one driving means for moving the apparatus in the pipe, a pair of tanks for containing respective paint materials such as main material and hardener, a pair of feeding devices for feeding the respective paint materials, and a paint injecting device for making paint by mixing the paint materials fed by the feeding devices and injecting the paint to the interior surface of the pipe. The paint injecting device has a hollow rotary injector which is rotated by a driving means and has at least one radially elongated portion forming a nozzle at outer end thereof. The radially elongated portion of the rotary injector has a plurality of guide plates inside thereof for mixing the paint materials passing therethrough.

4 Claims, 8 Drawing Figures

LINING APPARATUS FOR PIPES

FIELD OF THE INVENTION

This invention relates to a lining apparatus for the interior of pipes, and more particularly to an apparatus for pipes having large interior diameters thereof.

In more specific aspect, the invention relates to a lining apparatus for a pipe having a plurality of constitutive elements which are connected to each other in a line and include as a whole at least one driving means for moving the apparatus in the pipe, a pair of tanks for containing respective paint materials being main material and hardener, a pair of feeding devices for feeding the respective paint materials, and a paint injecting device for making paint by mixing the paint materials fed by the feeding mevices and injecting the paint to the interior surface of the pipe which has a hollow rotary injector which is rotated by a driving means and has at least one radially elongated portion formed a nozzle at outer end thereof.

BACKGROUND OF THE INVENTION

Hitherto, various such lining apparatuses have been suggested. For example, a pipeline coating system is disclosed in U.S. Pat. No. 3,135,629, and it has an applicator for coating paint, the paint materials being mixed by a blender instead of an injecting device. In U.S. Pat. No. 2,910,042, an apparatus is disclosed which has two or more nozzle tubes extending radially outwardly from the central portion for injecting the paint to sealing portions of pipes. In case of lining work of a pipe having a large interior diameter by a mixed main material and hardener such as epoxy resin paint and the like, it is necessary to supply a great quantity of the well mixed paint. But, the main material and the hardener have a large viscosity, therefore the perfect mixing of the paint materials is very difficult in the prior arts.

OBJECT OF THE INVENTION

Accordingly, one object of the present invention is to provide a lining apparatus for a pipe which enables one to obtain a great quantity of the well mixed paint for lining of the pipe having a large interior diameter thereof.

SUMMARY OF THE INVENTION

The present invention provides a lining apparatus for a pipe having a plurality of constitutive elements which are connected to each other in a line and include as a whole at least one driving means for moving the apparatus in the pipe, a pair of tanks for containing respective coating or paint materials such as a main material and hardener, a pair of feeding devices for feeding the respective coating materials, and an injecting device for mixing the coating materials fed by the feeding devices and injecting the mixture to the interior surface of the pipe. The injecting device has a hollow rotary injector which is rotated by a driving means and has at least one radially elongated portion forming a nozzle at outer end thereof. The radially elongated portion of the rotary injector has a plurality of guide plates inside thereof for mixing the coating materials passing therethrough.

BRIEF DESCRIPTION OF DRAWINGS

Other objects, features, and attendant advantages of the present invention will be more clear by following description referring to accompanying drawings wherein.

DETAILED DESCRIPTION

Figure 1:
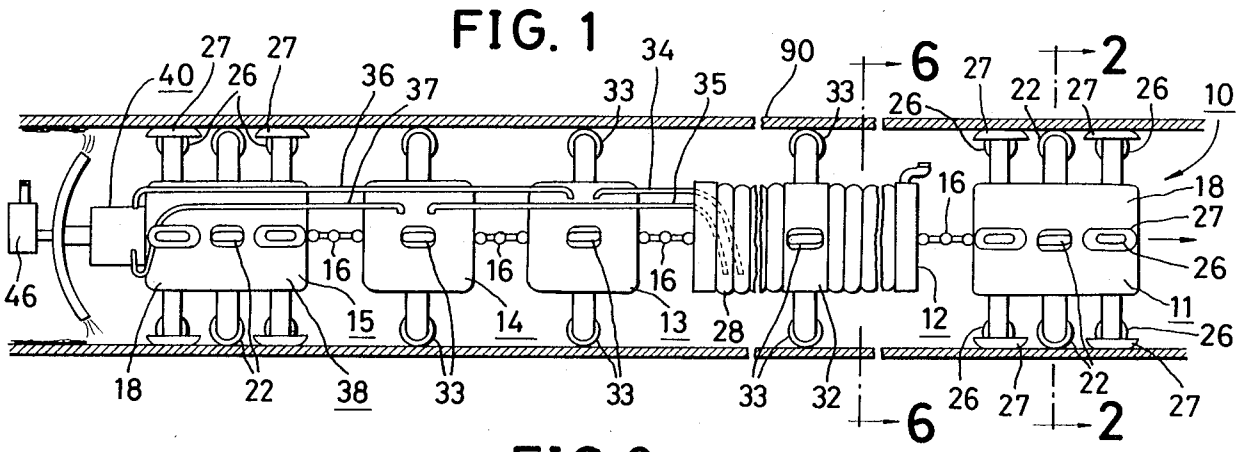
FIG. 1 is a side view of an embodiment of the present invention partially cut away showing a using condition.
Figure 2:
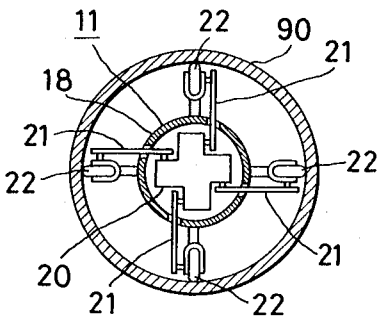
FIG. 2 is a sectional view taken along the line 2—2 in FIG. 1.
Figure 3:
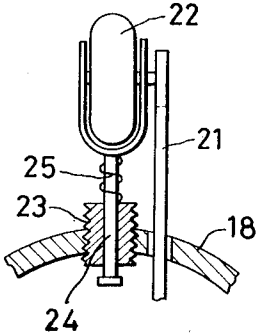
FIG. 3 is a front view of a driving wheel partially sectioned.
Figure 4:
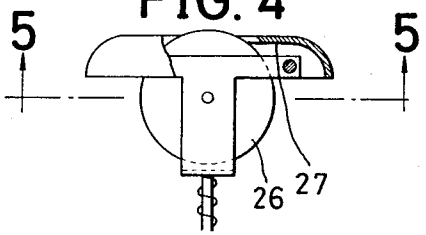
FIG. 4 is a side view of a guide wheel partially sectioned.
Figure 5:
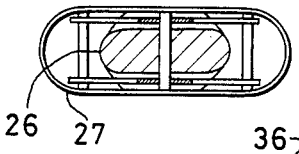
FIG. 5 is a sectional view taken along the line 5—5 in FIG. 4.

In an embodiment of the present invention shown in FIG. 1, 10 generally designates a lining apparatus. 90 designates a pipe to be lined which has a large interior diameter. The apparatus 10 has five constitutive elements 11, 12, 13, 14, 15 which are connected to each other to a line by connecting devices 16 each of which is a universal joint having three or more omnidirectional pivotal portions or a connector having three or more omnidirectional pivotal portions using balls.

Referring now to FIGS. 1-5, the constitutive element 11 is a driving device for moving the lining apparatus 10 in the pipe 90 disposed at one end of the apparatus and has a casing 18, a prime mover 20, such as an electric motor or an oil pressure motor, disposed in the casing and four driving wheels 22 which are driven by the prime mover using belts 21. The driving wheel is installed to the casing 18 so as to adjust its position by means of a screw 23 engaged to the casing, a supporting shaft 24 being elongated through the screw and a spring 25 for contacting to the interior surface of the pipe 90. The belt 21 is tightened by a not shown tightening device. A plurality of guide wheels 26 are installed to the casing 18 by a similar manner with the driving wheels 22, but each of which is not driven. A guide member 27 is installed to the supporting portion of each guide wheel for avoidance of the incline of the constitutive element 11 at a not shown connecting portion of the pipe 90 or the like.

Figure 6:
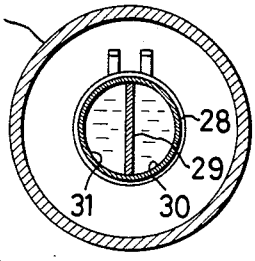
FIG. 6 is a sectional view taken along the line 6—6 in FIG. 1.

Referring now to FIGS. 1 and 6, the constitutive element 12 is a tank assembly for containing the materials of the paint and has a large length and is composed of an outer surface member 28 made of bellows of a soft elastical material, such as rubber or the like, and a partition member 29 made of the same material as the outer surface member. The partition member separates the space in the outer surface member 28 to a pair of tanks 30, 31 for containing the main material and hardener, respectively. The main material and hardener may be materials of epoxy resin paint or other similar paint. 32 designates an annular member which surrounds the outer surface member 28 at central portion thereof and is fixed thereto. Four wheels 33 are installed to the annular member 32 by a similar manner with the driving wheels 22, but each of which is not driven. The constitutive elements 13, 14 are feeding devices having not shown pumps which feed the main material and hardener in the tanks 30, 31 by means of hoses 34, 35 to hoses 36, 37, respectively. Each of the constitutive elements 13, 14 has four wheels 33 each of which is installed by the same manner with the wheels 33 of the constitutive element 12.

Figure 7:
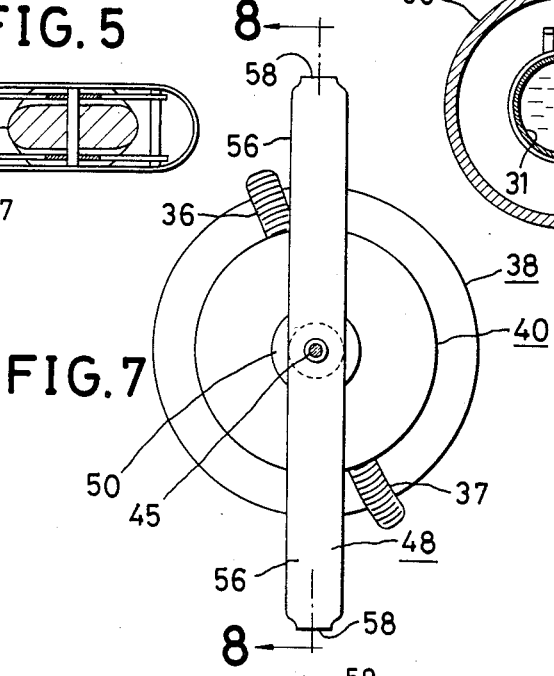
FIG. 7 is a front view of a paint injecting device partially sectioned.
Figure 8:
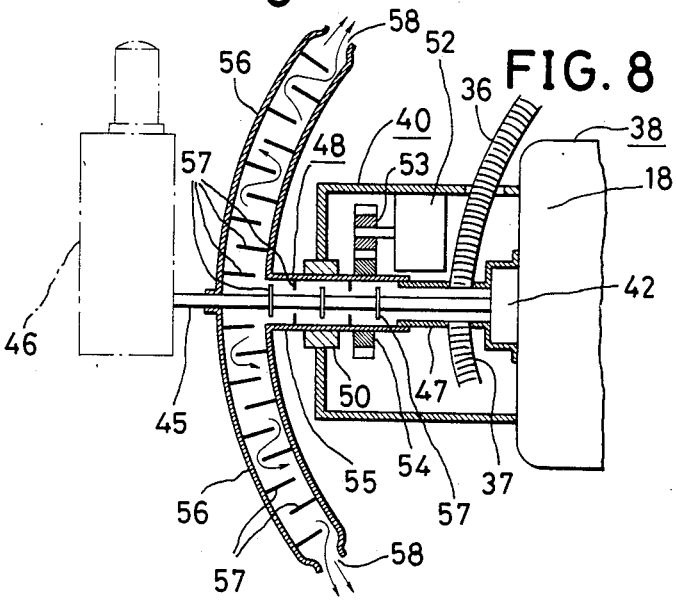
FIG. 8 is a sectional view taken along the line 8—8 in FIG. 7.

Referring now to FIGS. 1, 7 and 8, the constitutive element 15 is composed of a driving device 38 which is the same construction with the constitutive element 11 and a paint injecting device 40. The driving device 38 has a casing 18, a not shown prime mover 20, driving wheels 22 and guide wheels 26 associated with guide members 27. The paint injecting device 40 has an oil pressure motor 42 which is installed to the casing 18 and has a shaft 45 which is rotated slowly. A video camera 46 is attached to the outer end of the shaft 45. A tubular memeber 47 is fixed to the casing 18 so as to surround the inner end of the shaft 45 so as to face in the radial direction, thus the condition of the lining conforms perfectly to the outer space. The ends of the hoses 36, 37 are connected to the tubular member 47 so as to supply the main material and the hardener for making the point. A rotary injector 48 is disposed so as to connect to the tubular member 47 and has a tubular portion 55 and a pair of radially elongated portions 56 which are hollow and branched from the tubular portion. The tubular portion 55 is journaled by a bearing 50 and driven at 800 to 1,000 r.p.m. by means of a driving device 52 such as an electric motor or an oil pressure motor fixed to the casing 18 and gears 53, 54. The shaft 45 is elongated through the rotary injector 48. Many guide plates 57 are installed to the tubular portion 55 and the shaft 45 so as to project alternately therefrom and are installed to the radially elongated portions 56 so as to project alternately from the front sides and the back sides thereof, thus the passages in the rotary injector 48 are suitably bent for mixing the paint materials. When the rotary injector is rotated, a large centrifugal force is exerted on the point materials in each of the radially elongated portions, therefore the paint materials having large viscosity can be easily passed through the passages of the rotary injector, thus well mixed paint is obtained. The guide plates disposed in the radially elongated portions 56 may be formed so as to project from the left sides and the right sides thereof without projecting from the front sides and the back sides thereof. Nozzles 58 are formed at the outer ends of the radially elongated portions 56.

The apparatus 10 has a not shown storage battery as the source of electric current and a not shown oil pump driven by a not shown electric motor as the pressure oil source. The electric current may be supplied using electric wires from the outer space without the storage battery.

When the apparatus is progressing in a direction of an arrow head in FIG. 1 by the prime movers 20 of the constitutive elements 11 and 15 and the pumps of the constitutive elements 13, 14 are driven and the rotary injector 48 is driven, the paint which is well mixed by passing through the rotary injector 48 is injected to the interior surface of the pipe 90 from the nozzles 58 and adheres uniformly thereto, thus the lining of the interior surface of the pipe is obtained. The condition of the lining can be watched at the outer space by the signal of the video camera 46, and the control signal of the lining apparatus is transmitted by wireless signal. The apparatus can progress in a not shown bent portion of the pipe 90 in any direction, wherein the centers of the constitutive elements 11, 12, 13, 14, 15 can be passed along the center of the bent portion of the pipe without any trouble and the lining can be made thereto. In case of the length of the constitutive element 12 is long, it can be bent along the interior surface of the bent portion of the pipe by contacting thereto.

It is possible to make various changes of the above described embodiment. The main material and the hardener of the paint may be contained in different constitutive elelments. In such case, the constitutive elements may be constructed with hard material without flexibility. The constitutive element 15 may be composed of only the paint injecting device 40 without the driving device 38. In case of the apparatus being used for only horizontally elongated pipes, each constitutive element may have only wheels for supporting thereof at the bottom. The rotary injector 48 may have three or more radially elongated portions 56 or may have only one radially elongated portion 56.

The foregoing is of course considered as illustrative only of the principle of the invention. Obviously, numerous modifications of the present invention are possible in light of the above teachings.

I claim:

1. A lining apparatus for a pipe, comprising:
   - a plurality of constitutive elements mutually connected in a line;
   - means for moving said elements within a pipe;
   - tank means associated with one of said elements, said tank means including means for separately holding a main lining material and a hardener;
   - an injecting device; and
   - means for feeding said main lining material and said hardener to said injecting device;
   - wherein said injecting device comprises:
     - (a) a hollow rotary element having at least one radially elongated portion defining a radially elongated flow path;
     - (b) a nozzle at a radially outer end of said radially elongated portion,
     - (c) means for rotating said rotary element, and
     - (d) a plurality of guide plates extending into said flow path in each said at least one radially elongated portion,
   - wherein said main lining material and said hardener are forcibly mixed in said radially elongated portion.

2. The apparatus of claim 1 including omnidirectional link means connecting adjacent ones of said elements.

3. The apparatus of claim 1 including a radially directed video camera.

4. The apparatus of claim 2 including a radially directed video camera.

* * * * *